US007302927B1

(12) United States Patent
Scharp

(10) Patent No.: US 7,302,927 B1
(45) Date of Patent: Dec. 4, 2007

(54) TWO-PART PISTON FOR AN INTERNAL COMBUSTION ENGINE

(75) Inventor: Rainer Scharp, Vaihingen (DE)

(73) Assignee: MAHLE International GmbH, Stuttgart (DE)

( * ) Notice: Subject to any disclaimer, the term of this patent is extended or adjusted under 35 U.S.C. 154(b) by 10 days.

(21) Appl. No.: 11/451,258

(22) Filed: Jun. 12, 2006

(30) Foreign Application Priority Data

Dec. 17, 2005 (DE) ..... 10 2005 060 548

(51) Int. Cl.
*F02F 31/00* (2006.01)

(52) U.S. Cl. ..... 123/193.6; 92/220; 92/256

(58) Field of Classification Search ..... 92/208, 92/215–217, 219–221, 256; 123/193.6
See application file for complete search history.

(56) References Cited

U.S. PATENT DOCUMENTS 4,375,782 A * 3/1983 Schieber ..... 92/176
5,081,968 A * 1/1992 Bruni ..... 123/193.6
6,729,291 B1 * 5/2004 Scharp et al. ..... 123/193.6
2006/0225568 A1 * 10/2006 Ullrich ..... 92/186

FOREIGN PATENT DOCUMENTS

| | | |
|---|---|---|
| DE | 2338045 | 1/1974 |
| EP | 0604223 A1 | 6/1994 |
| GB | 1439328 | 6/1976 |

* cited by examiner

*Primary Examiner*—Marguerite McMahon
(74) *Attorney, Agent, or Firm*—Collard & Roe, P.C.

(57) ABSTRACT

Proposed is a two-part piston 1 for an internal combustion engine, having an upper part 2 that has a pin 31 having an outside thread 32 on the underside of its piston crown 4, and having a lower part 3, which is connected with the upper part 2 by means of a nut 29 screwed onto the pin 31. The lower part 3 has an elastically resilient upper base part 25, onto which an expansion sleeve 26, elastic in the axial direction, is formed, which has an opening 27 having a collar 28, which is directed radially inward, into which the pin 31 is introduced. An elastic compression sleeve 30 is formed onto the nut 29, which sleeve rests against the collar 28. In this connection, the elastic resilience of the base part 25, the expansion sleeve 26, the compression sleeve 30, the pin 31, and the piston crown 4 has the result that the screw connection has a flat characteristic line despite a low compression height of the piston 1, thereby imparting great strength to the screw connection.

9 Claims, 3 Drawing Sheets

TWO-PART PISTON FOR AN INTERNAL COMBUSTION ENGINE

The invention relates to a two-part piston for an internal combustion engine, in accordance with the preamble of claim 1.

A two-part piston is known from the European Patent Application having the number 0 604 223 A1, which consists of an upper part and a lower part, whereby a pin having an outside thread is affixed on the underside of the upper part that faces away from the piston crown, by way of which pin the upper part and the lower part are screwed together. In this connection, only a slight bias is exerted on the screw connection thereby, in that the pin has a relatively great length and therefore demonstrates a certain elasticity. A disadvantage in this connection is the space required for the pin, which prohibits a reduction in the compression height of the piston.

It is the task of the present invention to avoid the stated disadvantage of the prior art, and nevertheless to create a fixed screw connection between the upper part and the lower part of a two-part piston.

This task is accomplished with the characteristics that stand in the characterizing part of the main claim. Practical embodiments of the invention are the object of the dependent claims.

Figure 1:
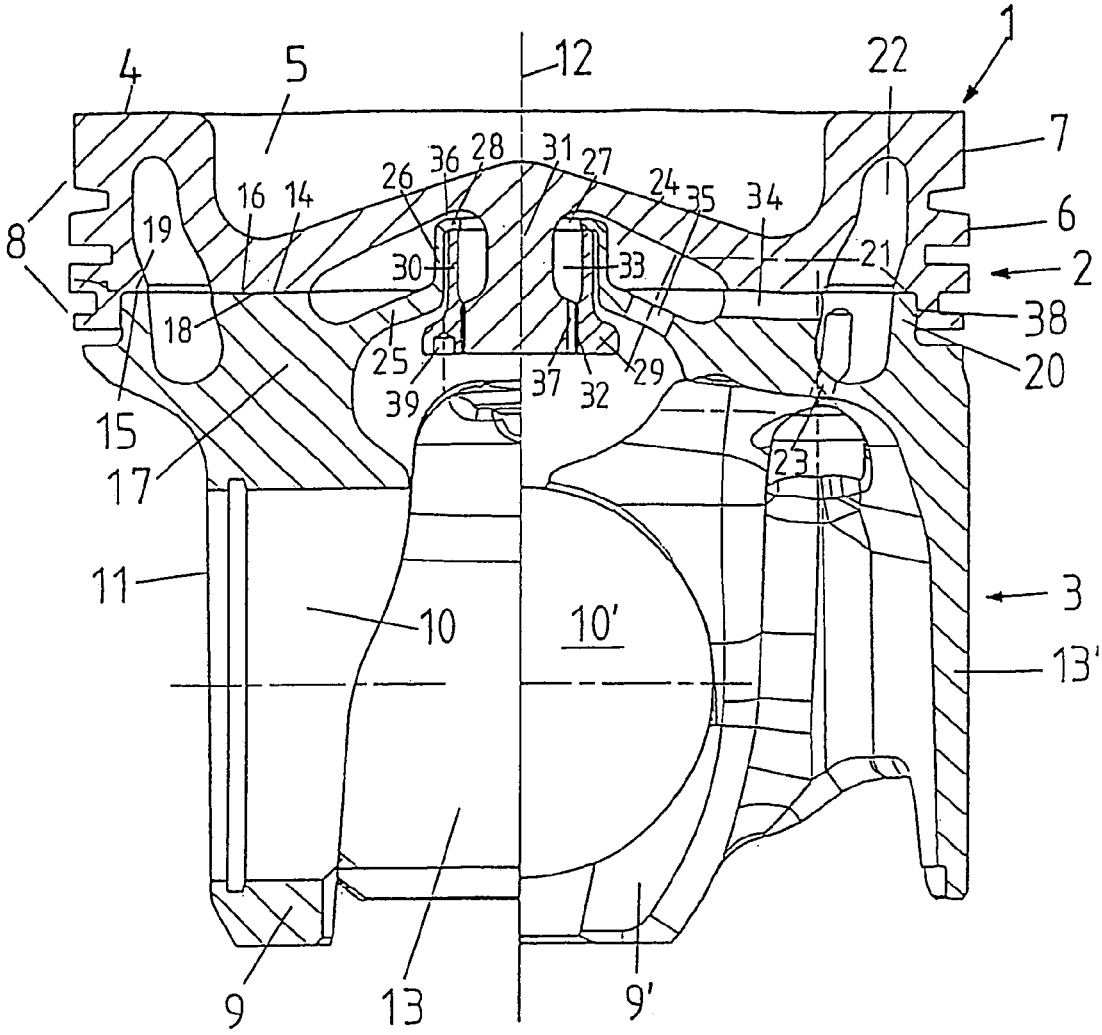
Figure 2:
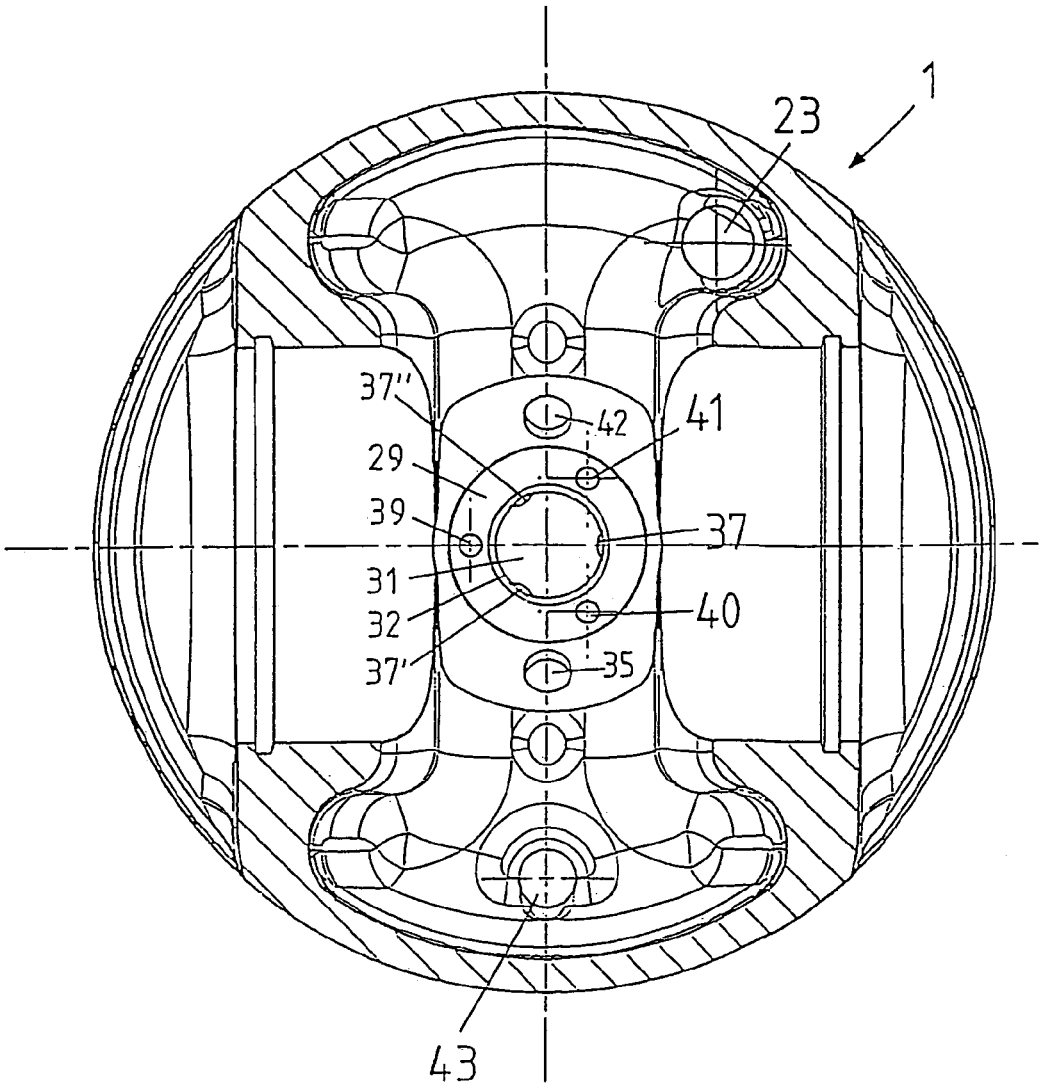
Figure 3:
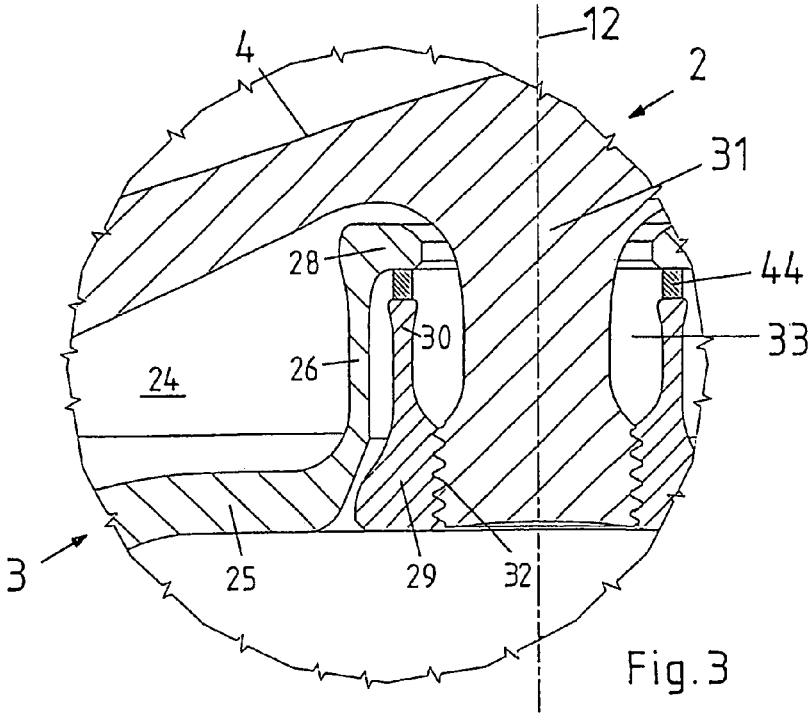
Figure 4:
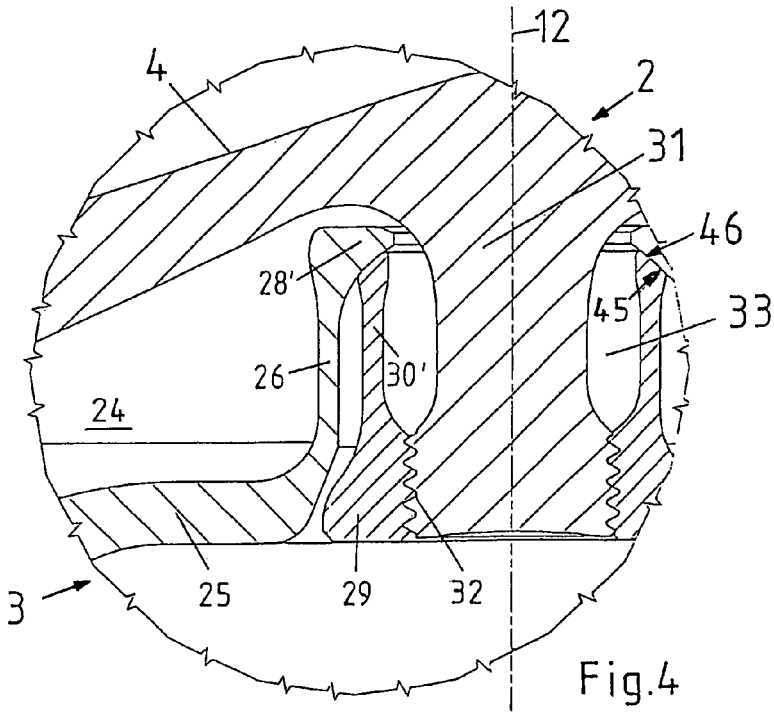

The invention is described below, using the drawings. These show:

FIG. 1 a sectional diagram of a two-part piston, whose upper part and whose lower part are screwed onto one another by means of a nut having a compression sleeve molded on, FIG. 2 a view of the piston according to the invention from underneath, FIG. 3 a configuration of the screw connection according to the invention, whereby a washer is disposed between the compression sleeve and a collar formed on the compression sleeve, and FIG. 4 configurations of the compression sleeve and the collar, according to which their contact surfaces are configured to narrow conically, in the direction of the piston crown.

FIG. 1 shows a two-part, cooled piston 1, which consists of an upper part 2 and a lower part 3. The upper part 2 and the lower part 3 can be made from steel or from another metallic material. A piston crown 4 delimits the axial top of the upper part 2, the radially inner region of which has a combustion bowl 5. A ring wall 6 is formed on the outer edge of the piston crown 4, the outer surface of which wall forms a top land 7 on the piston crown side, followed on the skirt side by a ring belt 8 having ring grooves to accommodate piston rings, not shown in the figure.

Two pin bosses 9, 9' are disposed on the underside of the lower part 3, which faces away from the piston crown 4, which bosses each have a pin bore 10, 10', the faces 11 of which are disposed set back relative to the ring wall 6, in the direction of the piston axis 12. The pin bosses 9, 9' are connected with one another by way of piston skirt elements 13, 13'.

The upper part 2 and the lower part 3 of the piston 1 are connected with one another by way of an inner contact region 14 and by way of an outer contact region 15 disposed concentric to the former. The inner contact region 14 is formed by a contact surface 16 disposed on the side of the upper part 2 that faces away from the combustion bowl 5, and by a contact surface 18 disposed on a ring-shaped support rib 17 of the lower part 3, on the piston crown side.

The outer contact region 15 is formed by a contact surface 19 that delimits the underside of the ring wall 6, and by a contact surface 21 disposed on a ring-shaped support ridge 20 of the lower part 3, on the piston crown side.

A cooling channel 22 disposed in the edge region of the piston 1, on the piston crown side, is formed by the upper part 2 and by the lower part 3 of the piston 1; the radially outer delimitation of this channel is formed by the ring wall 6, the radially inner delimitation is formed partly by the support rib 17 and partly by the piston crown 4, and the axially lower delimitation is formed by the lower part 3 of the piston 1. Cooling oil is introduced into the cooling channel 22 by way of inlet openings 23.

The piston 1 has a further cooling channel 24, disposed coaxial to the piston axis 12, and ring-shaped, which has a lesser radial diameter than the outer cooling channel 22 and, viewed in the radial direction, is disposed within the outer cooling channel 22. The inner cooling channel 24 is delimited axially at the top by the piston crown 4, radially on the outside by the support rib 17, and radially at the bottom by an upper base part 25 of the lower part 3 configured with thin walls and so as to be slightly resilient, onto which an expansion sleeve 26 that is directed axially upward is formed, whose opening 27, which lies axially on the top, is provided with a collar 28 that is directed radially inward so far that the underside of the collar 28 can serve as a stop for a compression sleeve 30 that is formed onto the nut 29. In this connection, the expansion sleeve 26 forms the radially inner delimitation of the inner cooling channel 24.

A cylindrical pin 31 having a mantle surface that has an end region facing away from the piston crown, having an outside thread 32 that corresponds to the inside thread of the nut 29, is formed on the underside of the piston crown 4, coaxial to the piston axis 12, so that the nut 29 can be screwed onto the outside thread 32. The axial length of the pin 31 corresponds approximately to the axial length of the nut 29 that is provided with the compression sleeve 30. The radial diameter of the pin 31 and, in particular, that of its outside thread 32, are slightly less than the radial diameter of the opening 27 of the expansion sleeve 26, so that the pin 31 can easily be introduced into the opening 27. The radial inside diameter of the compression sleeve 30 is slightly greater than the radial outside diameter of the outside thread 32 of the pin 31.

In the present exemplary embodiment, the radial diameter of the pin 31 is configured to be less in a region between its outside thread 32 and the underside of the piston crown 4 than the diameter of the outside thread 32, and also less than the inside diameter of the compression sleeve 30, so that a ring-shaped cooling chamber 33 results between the compression sleeve 30 and the pin 31.

Cooling oil is introduced into the outer cooling channel 22 by way of the inlet opening 23, flows into the inner cooling channel 24 by way of a connection channel 34, from where part of the oil flows back into the crankcase by way of an opening 35 in the upper base part 25 of the lower part 3. A small part of the oil flows between the collar 28 and the lower surface of the piston crown 4, by way of a gap 36, and into the cooling chamber 33 by way of the opening 27 of the expansion sleeve 26, from where it flows back into the crankcase by way of run-off channels worked into the outside thread 32 of the pin 31, which lie parallel to the piston axis 12; one of these run-off channels 37 is shown in FIG. 1. This results in very good cooling of the upper part 2 of the piston 1, which is under great thermal stress.

During the assembly of upper part 2 and lower part 3 of the piston 1, the pin 31, which is disposed on the underside of the piston crown 4, is first guided through the opening 27 of the expansion sleeve 26, which is formed onto the upper base part 25 of the lower piston part 3. During the course of further assembly of the piston 1, the upper part 2 and the lower part 3 of the piston 1 are oriented coaxial to one another, and this is achieved in that the support ridge 20 has the shape, in cross-section, of a step directed radially inward and axially in the direction of the piston crown 4, and that the lower face of the ring wall 6 has a cylinder-shaped recess 38 on the inside, the inside shape of which corresponds to the outside shape of the support ridge 20, so that during assembly of upper and lower part 2, 3 of the piston 1, the support ridge 20 is introduced into the recess 38, and thereby upper part 2 and lower part 3 are oriented to be coaxial.

Subsequent to this, the compression sleeve 30 of the nut 29 is pushed over the outside thread 32 of the pin 31, until the inside thread of the nut 29 comes into contact with the outside thread 32 of the pin 31. The nut 29 is now screwed onto the outside thread 32 until the upper face of the compression sleeve 30 makes contact with the collar 28 of the expansion sleeve 26.

Tightening the nut 29 further, by exerting a certain torque, now has the result that the elastically resilient upper base part 25 deforms in the manner of a cup spring, in the direction of the piston crown 4, that the expansion sleeve 26, which is configured to have a thin wall, expands axially, that the compression sleeve 30, which is also configured to have a thin wall, is axially compressed, that the center part of the pin 31 undergoes expansion with a reduced radial diameter, and that the part of the piston crown 4 that delimits the combustion bowl 5 deforms in the skirt direction, in the manner of a cup spring. This elastic deformation of the piston parts 25, 26, 30, 31, and 4 results in a very flat characteristic line of the screw connection between nut 29 and pin 31, which imparts great strength to this screw connection, independent of temperature influences and mechanical influences on the piston 1.

The nut 29 can be configured as a hexagonal nut. However, advantages are obtained in the assembly of the piston 1 if the nut 29 has bores 39, 40, and 41 on the face that faces away from the piston crown, as indicated in FIG. 1 and shown well in FIG. 2. In this way, it is possible to tighten the nut 29 using a wrench that has the shape of a narrow cylinder having approximately the same radial diameter as the nut 29, and on the face of which pins are affixed that have the same distance from one another as the bores 39, 40, 41, and which furthermore have a shape complementary to them. A very great torque can be transferred to the nut 29 with wrenches configured in this manner. Furthermore, this wrench has a relatively small radial diameter, so that it can be used very well for tightening the nut 29, which is relatively difficult to access.

In the view of the piston 1 from below according to FIG. 2, the opening 35 and another opening 42 for passing out the oil situated in the inner cooling channel 24 are shown. Furthermore, in FIG. 2 the inlet opening 23 and an outlet opening 43 of the outer cooling channel 22 can be seen, which serve to pass the cooling oil in and out. Also, the three run-off channels 37, 37', 37" formed into the outside thread 32 of the pin 31, which serve to pass out the oil collected in the cooling chamber 33 between the pin 31 and the compression sleeve 30, can be seen well in FIG. 2.

FIG. 3 shows a configuration of the screw connection of the upper piston part 2 and the lower piston part 3, according to the invention, in which a washer 44 is disposed between the collar 28 that is formed onto the expansion sleeve 26 and directed radially inward, and the compression sleeve 30. The washer 44 has the effect that it distributes the surface pressure that is exerted on the collar 28 in the screwed-in state of the compression sleeve 30 more uniformly over the entire circumference of the contact region between collar 28 and compression sleeve 30.

According to FIG. 4, the surfaces 45 of the collar 28' and 46 of the compression sleeve 30' that stand in contact with one another are configured to narrow conically towards the piston axis 12. The surfaces 45 and 46 can also be configured in ball-shaped manner, and narrow conically towards the piston axis 12, in the direction of the piston crown 4. In this way, a reduction of the material stress that prevails in the expansion sleeve 26, in the collar 28' and in the compression sleeve 30' in the screwed-in state is achieved. Furthermore, a washer can be disposed between the surfaces 45 and 46, thereby achieving the additional advantage of making the surface pressure exerted on the collar 28 by the compression sleeve 30 more uniform.

REFERENCE SYMBOL LIST

| | |
|---|---|
| 1 | piston |
| 2 | upper part |
| 3 | lower part |
| 4 | piston crown |
| 5 | combustion bowl |
| 6 | ring wall |
| 7 | top land |
| 8 | ring belt |
| 9, 9' | pin boss |
| 10, 10' | pin bore |
| 11 | face of the pin boss 9, 9' |
| 12 | piston axis |
| 13, 13' | piston skirt element |
| 14 | inner contact region |
| 15 | outer contact region |
| 16 | contact surface of the upper part 2 |
| 17 | support rib of the lower part 3 |
| 18 | contact surface of the lower part 3 |
| 19 | contact surface |
| 20 | support ridge |
| 21 | contact surface |
| 22 | outer cooling channel |
| 23 | inlet opening |
| 24 | inner cooling channel |
| 25 | upper base part of the lower part 3 |
| 26 | expansion sleeve |
| 27 | opening |
| 28, 28' | collar |
| 29 | nut |
| 30, 30' | compression sleeve |
| 31 | pin |
| 32 | outside thread |
| 33 | cooling chamber |
| 34 | connection channel, oil in-flow opening |
| 35 | opening, oil out-flow opening |
| 36 | gap |
| 37, 37', 37" | run-off channel |
| 38 | cylinder-shaped recess |
| 39, 30, 41 | bore |
| 42 | opening |
| 43 | outlet opening |
| 44 | washer |
| 45 | surface of the collar 28' that stands in contact with the compression sleeve 30' |
| 46 | surface of the compression sleeve 30' that stands in contact with the collar 28' |

The invention claimed is:

1. Two-part piston (1) for an internal combustion engine, having an upper part (2) that forms a piston crown (4), and on the underside of which, facing away from the piston crown (4), a cylindrical pin (31) having an outside thread (32), which lies coaxial to the piston axis (12), is disposed, having a lower part (3), on the underside of which pin bosses (9, 9') with pin bores (10, 10') and skirt elements (13, 13') that connect the pin bosses (9, 9') with one another are disposed, whereby the lower part (3) has an opening (27), on the piston crown side, that lies coaxial to the piston axis (12), in which the pin (31) is guided, and whereby the upper part (2) and the lower part (3) are connected with one another by means of a nut (29) that is screwed onto the outside thread (32) of the pin (31) wherein the lower part (3) has an elastically resilient upper base part (25) that delimits a closed, ring-shaped cooling channel (24) disposed coaxial to the piston axis (12), having oil in-flow and out-flow openings (34, 35), on the skirt side, which channel is delimited by the upper part (2) on the piston crown side, whereby an expansion sleeve (26) disposed coaxial to the piston axis (12), directed upward, elastic in the axial direction, is formed onto the base part (25), radially on the inside, which forms the radially inner delimitation of the cooling channel (24), and which has the opening (27) on its piston-crown-side end, whereby the opening (27) is provided with a collar (28), which is directed radially inward, and that a compression sleeve (30) that lies coaxial to the piston axis (12) and is elastic in the axial direction is formed onto the nut (29), on the piston crown side, which rests against the collar (28) on the piston crown side.

2. Piston according to claim 1, wherein the outside thread (32) is worked into an end region of the mantle surface of the pin (31), facing away from the piston crown, and that the region of the pin (31) between the outside thread (32) and the piston crown (4) has a lesser radial diameter than the outside thread (32).

3. Piston according to claim 1, wherein the nut (29) has at least two bores 39, 40, 41) on the underside, into which pins disposed on a face of an essentially cylinder-shaped wrench fit.

4. Piston according to claim 1, wherein at least one run-off channel (37, 37', 37'') for guiding out the oil situated in a cooling chamber (33) between the pin (31) and the compression sleeve (30) is formed into the outside thread (32) of the pin (31).

5. Piston according to claim 1, wherein a washer (44) is disposed between the compression sleeve (30) and the collar (28).

6. Piston according to claim 1, wherein the surface (45) of the collar (28') that stands in contact with the compression sleeve (30') and the surface (46) of the compression sleeve (30') that stands in contact with the collar (28') are configured to narrow toward the piston axis (12), in the direction of the piston crown (4).

7. Piston according to claim 1, wherein the surface (45) of the collar (28') that stands in contact with the compression sleeve (30') and the surface (46) of the compression sleeve (30') that stands in contact with the collar (28') are configured to narrow conically towards the piston axis (12), in the direction of the piston crown (4).

8. Piston according to claim 1, wherein the surface (45) of the collar (28') that stands in contact with the compression sleeve (30') and the surface (46) of the compression sleeve (30') that stands in contact with the collar (28') have a ball-shaped shape and are configured to narrow towards the piston axis (12), in the direction of the piston crown (4).

9. Piston according to claim 1, wherein a washer (44) is disposed between the surface (45) of the collar (28') and the surface (46) of the compression sleeve (30').

* * * * *